US007357420B2

(12) United States Patent
Hyser

(10) Patent No.: US 7,357,420 B2
(45) Date of Patent: Apr. 15, 2008

(54) FRAME PROTECTOR FOR IN-LINE SKATE FRAME

(75) Inventor: Thomas J. Hyser, Lawrenceville, GA (US)

(73) Assignee: Epoch Design, Inc., Lawrenceville, GA (US)

( * ) Notice: Subject to any disclaimer, the term of this patent is extended or adjusted under 35 U.S.C. 154(b) by 194 days.

(21) Appl. No.: 11/063,165

(22) Filed: Feb. 18, 2005

(65) Prior Publication Data

US 2006/0113735 A1 Jun. 1, 2006

Related U.S. Application Data

(60) Provisional application No. 60/545,335, filed on Feb. 18, 2004.

(51) Int. Cl.
*A63C 3/00* (2006.01)
*A63C 3/12* (2006.01)

(52) U.S. Cl. ..... 280/825; 280/811

(58) Field of Classification Search ..... 280/841, 280/11.19, 11.27, 809, 811, 11.221
See application file for complete search history.

(56) References Cited

U.S. PATENT DOCUMENTS 5,290,065 A * 3/1994 Kassal ..... 280/825
5,522,621 A * 6/1996 Schneider ..... 280/825
5,630,624 A * 5/1997 Goodman ..... 280/809
D392,359 S * 3/1998 Gallegos ..... D21/776
5,765,870 A * 6/1998 Riley ..... 280/825
5,806,860 A * 9/1998 Conte ..... 280/11.231
D400,946 S * 11/1998 St. Amand et al. ..... D21/761
5,924,733 A * 7/1999 Palleschi ..... 280/825
6,089,580 A * 7/2000 Borel et al. ..... 280/11.221
6,446,983 B1 * 9/2002 Gaster ..... 280/11.221

* cited by examiner

*Primary Examiner*—Christopher P. Ellis
*Assistant Examiner*—Bridget Avery
(74) *Attorney, Agent, or Firm*—David E. Pritchard

(57) ABSTRACT

A frame protector may include a first protective sidewall and a second protective sidewall, with at least one of these protective sidewalls sized so as to extend essentially from proximate the first end to proximate the second end of an underlying frame sidewall, as well as downward to a point proximate the lower edge of an underlying frame sidewall. The frame-protector sidewalls may be connected together via a frame-protector bottom wall. And if desired, the sidewalls and bottom wall may be formed so as to include a downwardly-facing arcuate surface.

24 Claims, 5 Drawing Sheets

FRAME PROTECTOR FOR IN-LINE SKATE FRAME

CROSS-REFERENCED TO RELATED APPLICATION

This patent document claims the benefit of the filing date of Provisional U.S. Patent Application No. 60/545,335, entitled "Replaceable Frame Block for Use on Inline Skate Frames Which Protects and Captures Axles and Other Hardware Used on Inline Skate Frames and or Chassis" and filed on Feb. 18, 2004. The entire disclosure of Provisional U.S. Patent Application No. 60/545,335 is incorporated into this patent document by reference.

BACKGROUND OF THE INVENTION

1. Field of the Invention

This invention relates to in-line skate frames, and more particularly, to protectors for in-line skate frames.

2. Description of Related Art

Depending typically on the skater and/or the type of skating being performed, the frames of a pair of in-line skates may take quite a beating. For example, in use, the frames may become scratched or chipped; and in some cases, a frame may even bend or break—at which point, the frame must be replaced. Moreover, if a frame bends or breaks while a skater is wearing the frame, the skater may be seriously injured. The risk of significant frame damage is even greater for skaters who perform in-line skate stunts—stunts that become more extreme each year, as skaters seek to outdo what has been done before. Examples of such stunts include ramp skating, stair riding, jumping, curb and handrail sliding (typically referred to by extreme- or stunt-skaters as "grinding"), and "stalling" (coming to an abrupt stop).

In order to withstand the various forces to which they are subjected, many skate frames are quite rugged, and therefore, are relatively expensive. Accordingly, the cost to replace one or more worn or otherwise-damaged frames is quite significant. And if a skater is grinding on their frames, or performing various other stunts, they may need to replace their frames on a routine basis.

In an effort to address the wear-and-tear issue, one approach calls for a plate that has two "wings" connected by a base. The plate may be positioned on the frame between two wheels, preferably in the median portion of the frame. (See U.S. Pat. No. 5,806,860.) Another approach calls for a protective means mounted to the frame. In one embodiment, the protective means is mounted to the exterior surfaces of the inboard and outboard sides of the frame, and includes a lower portion spanning the underside of the frame. In another embodiment, the protective means may protrude beyond the underside of the frame. (See U.S. Pat. No. 6,416,081.) A further approach calls for a removable H-block that is centrally located along the length of the frame, between the two frame sidewalls. In this H-block approach, each of the sidewalls has a cut-out that extends upwardly from the sidewall lower edge; and a portion of the H-block fills each cut-out. (See U.S. Pat. No. 6,581,943 and U.S. Patent Application Publication No. US 2003/0227144.)

Although each approach offers some degree of protection to the frame, the protection is quite limited.

SUMMARY OF THE INVENTION

The present invention provides an in-line skate frame protector having a greater degree of frame protection than that of conventional frame protectors, without sacrificing the performance of the in-line skates. To this end, and in accordance with the principles of the invention, the frame-protection enhancement is accomplished by a frame protector that includes a first protective sidewall and a second protective sidewall, with at least one of these protective sidewalls sized so as to extend essentially from proximate the first end to proximate the second end of an underlying frame sidewall, as well as downward to a point proximate the lower edge of an underlying frame sidewall. The frame-protector sidewalls may be connected together via a frame-protector bottom wall. And, advantageously, the frame-protector may be an integral piece.

By virtue of the foregoing, there is thus provided a releasably-mountable in-line skate frame protector having a greater degree of frame protection than that of conventional frame protectors, without sacrificing the performance of the in-line skates. These and other advantages of the present invention will be apparent from the accompanying drawings and description of the drawings.

BRIEF DESCRIPTION OF THE DRAWINGS

The accompanying drawings, which are incorporated in, and constitute a part of this specification, illustrate embodiments of the invention, and, together with the general description of the invention given above, and the detailed description of embodiments of the invention given below, serve to explain the principles of the invention.

DETAILED DESCRIPTION OF THE DRAWINGS

For the benefit of the reader, in this Detailed Description, the same reference number may be used to identify identical or similar parts/components across different embodiments.

With reference to FIGS. 1-6, a skate frame protector 10, in accordance with the principles of the invention, for use with an in-line skate frame 12 is shown. As best seen in FIG.

Figure 1:
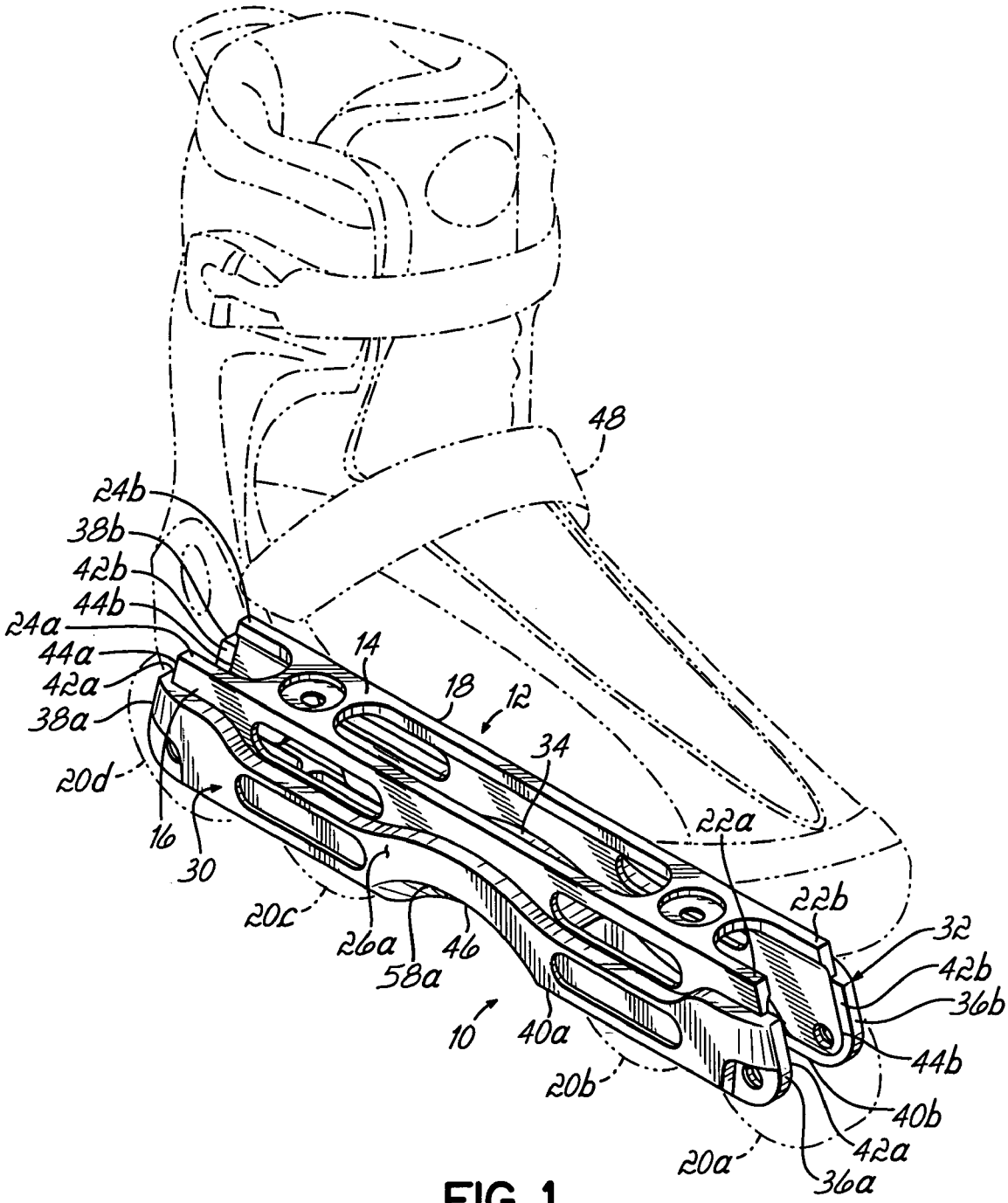
FIG. 1 is a perspective view of a frame protector, in accordance with the principles of the invention, releasably positioned on an in-line skate frame, as well as an in-line skate boot and series of in-line skate wheels shown in phantom.
Figure 2:
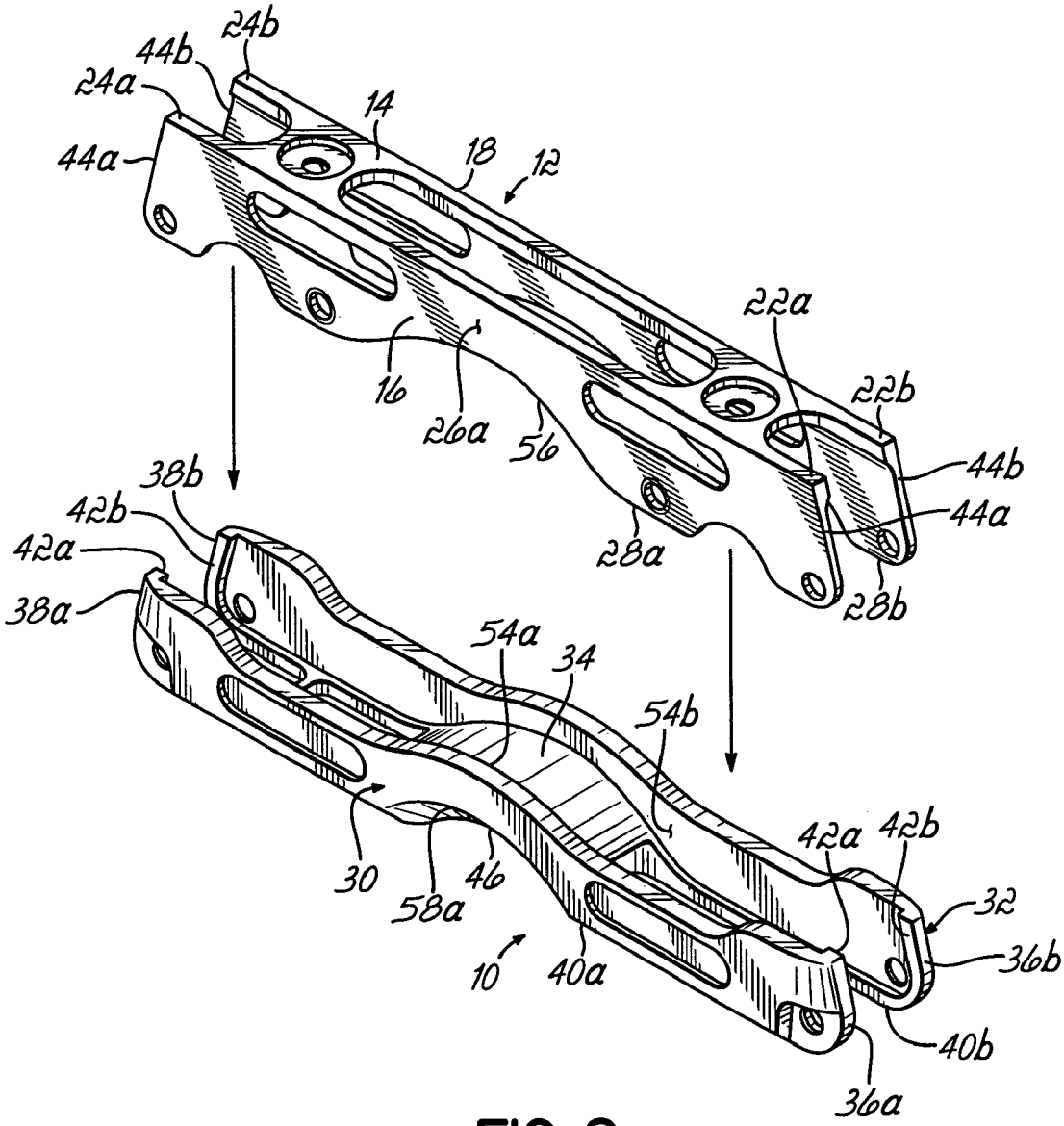
FIG. 2 is a disassembled perspective view of the frame-protector and in-line skate frame shown in FIG. 1.
Figure 3:
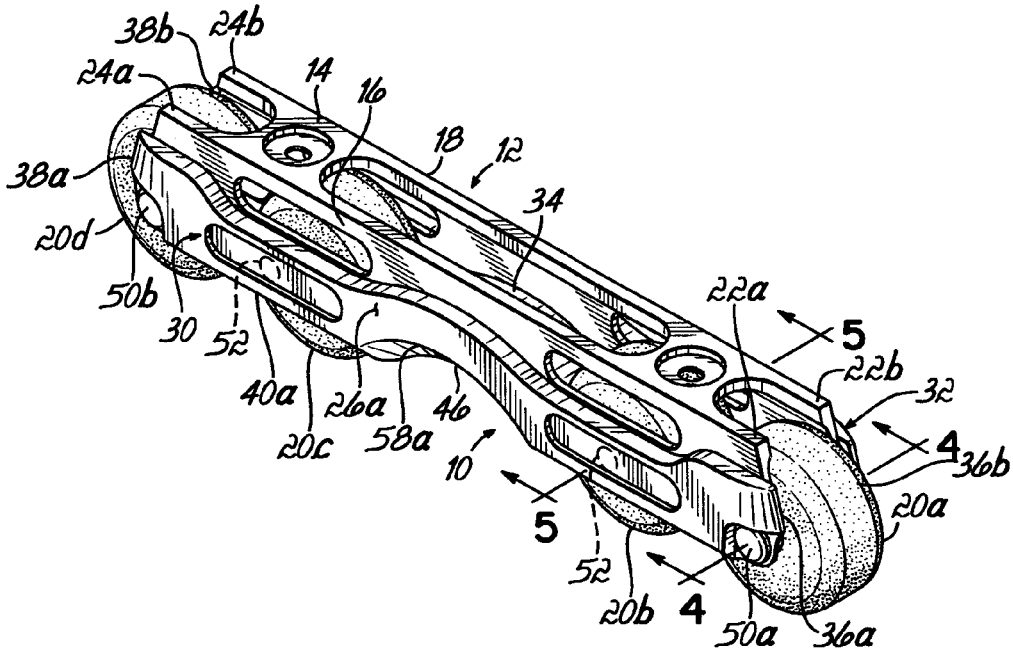
FIG. 3 is a perspective view of an in-line skate sub-assembly in which the frame protector and frame are substantially similar to those of FIGS. 1 and 2.

2, the in-line skate frame 12 includes a top wall 14 and first and second sidewalls 16, 18 depending from the top wall 14, with the frame 12 constructed and arranged so as to receive a plurality of in-line skate wheels 20*a,b,c,d* between the first and second sidewalls 16, 18 (see, e.g., FIGS. 1 and 3). Each of the frame first and second sidewalls 16, 18 includes a first end 22*a,b*, a second end 24*a,b*, an exterior surface 26*a,b*, and a lower edge 28*a,b* (see, e.g., FIG. 2).

As best seen in FIG. 2, the skate frame protector 10 includes a first protective sidewall 30, a second protective sidewall 32, and a bottom wall 34 that extends between, and connects, the first and second protective sidewalls 30, 32. As best appreciated with reference to FIGS. 1-3, each of the first and second protective sidewalls 30, 32 includes a first end 36*a,b*, a second end 38*a,b*, and a bottom edge 40*a,b*—each of which extends beyond the first end 22*a,b*, second end 24*a,b*, and lower edge 28*a,b* of the corresponding frame sidewall 16, 18. In addition, each of the first and second ends 36*a,b*, 38*a,b* and bottom edges 40*a,b* of the protective sidewalls 30, 32 includes a flange 42*a,b* that covers the peripheral edge 44*a,b* of the corresponding frame first end 22*a,b*, second end 24*a,b*, and lower edge 28*a,b*. Also, the frame protector 10 includes a downwardly-facing arcuate surface 46 positioned between the second and third wheels 20*b,c*. This surface is particularly beneficial for various grinding- and other-stunts.

With reference to FIG. 1, the frame protector 10 is shown positioned on the in-line skate frame 12. In addition, FIG. 1 shows an in-line skate boot 48 positioned on the top wall 14 of the frame 12, and a series of four in-line skate wheels 20*a,b,c,d* positioned between the first and second frame sidewalls 16, 18.

Figure 4:
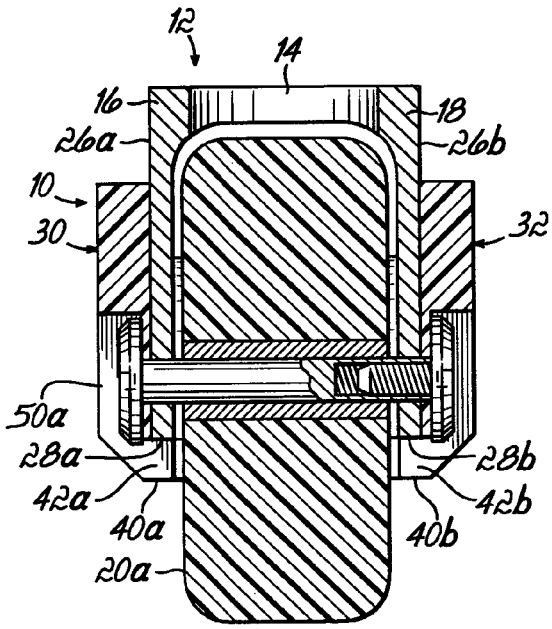
FIG. 4 is a cross-sectional view taken along line 4-4 of FIG. 3.
Figure 5:
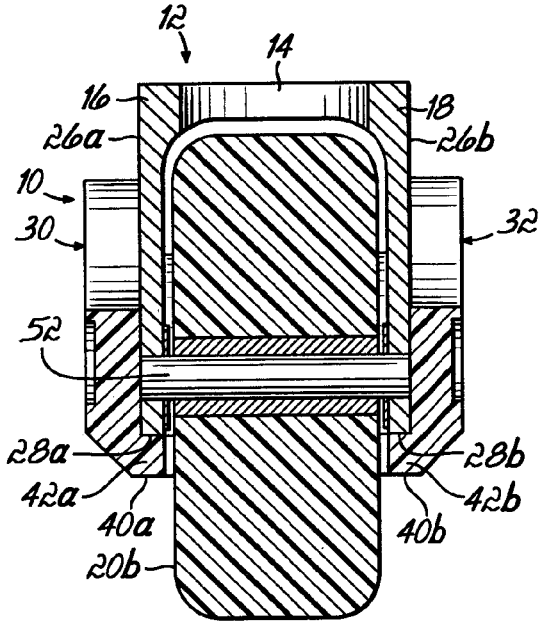
FIG. 5 is a cross-sectional view taken along line 5-5 of FIG. 3.

With reference to FIGS. 3-5, an in-line skate frame 12 and frame protector 10 (substantially similar to the embodiments shown in FIGS. 1 and 2) are illustrated as part of a sub-assembly. This particular sub-assembly includes a series of four wheels 20*a,b,c,d*, the skate frame 12, and the frame protector 10—all of which have been releasably assembled together. In this particular embodiment, the first and fourth wheels 20*a,d* are held in place via axle bolts 50*a,b* that extend through both the frame 12 and the frame protector 10 (FIG. 4). The second and third wheels 20*b,c* are held in place via axles 52 that extend through the frame 12 but not the frame protector 10 (FIG. 5). In further detail, each of the frame protector sidewalls 30, 32 includes an interior surface 54*a,b* (see, e.g., FIG. 2), with the interior surface 54*a,b* being solid at the locations where the ends of the axles 52 for the second and third wheels 20*b,c* are positioned. Accordingly, the sidewalls 30, 32 of the frame protector 10 serve to "capture" these axles 52 in the transverse or lateral direction, thereby eliminating the need for conventional axle bolts at these positions.

Figure 6:
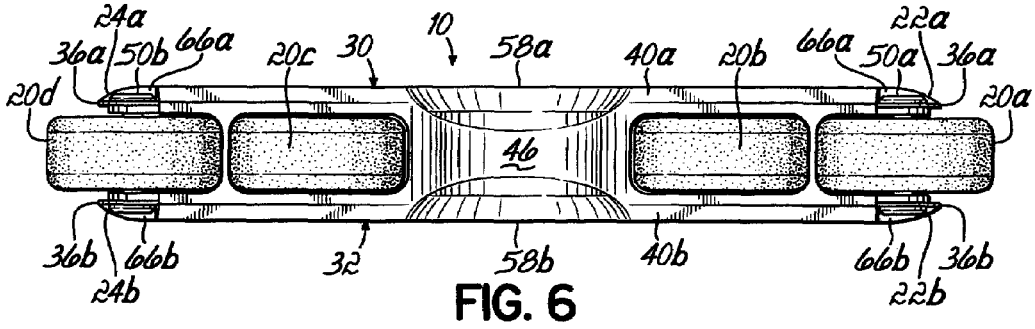
FIG. 6 is an elevated bottom view of the in-line skate sub-assembly shown in FIG. 3.

With reference to FIGS. 2, 3, and 6, both the frame 12 and frame protector 10 include downwardly-facing arcuate surfaces 56, 46. In further detail, each of the frame sidewalls 16, 18 has a centrally-located (as shown, between the second and third wheels 20*b,c*) section that includes a downwardly-facing arcuate lower edge 56. In addition, each of the frame-protector sidewalls 30, 32 includes a corresponding downwardly-facing arcuate bottom edge 58*a,b*.

Figure 7:
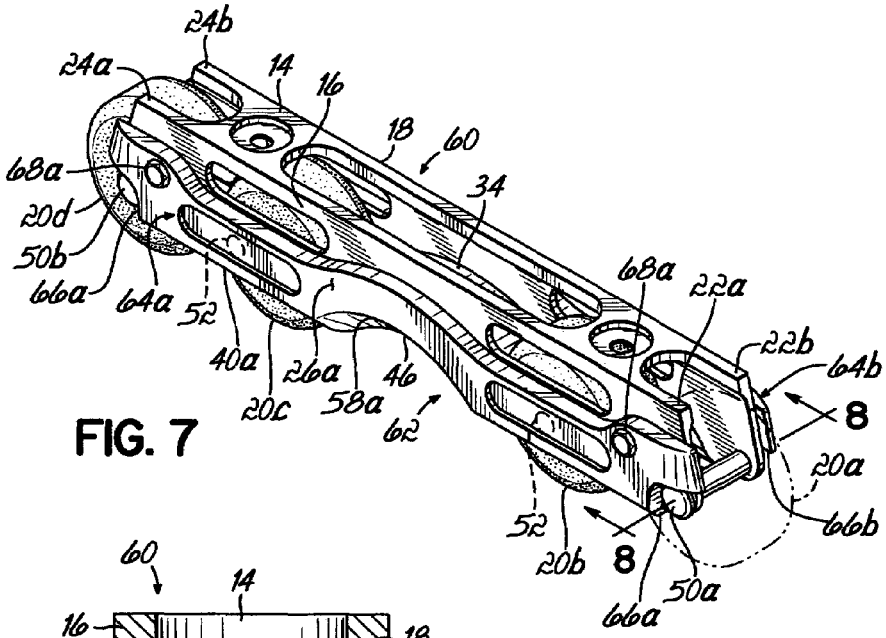
FIG. 7 is a perspective view of a further in-line skate sub-assembly in which another embodiment of the frame protector, in accordance with the principles of the invention, is releasably fastened to an in-line skate frame such as the frame of FIG. 2.
Figure 8:
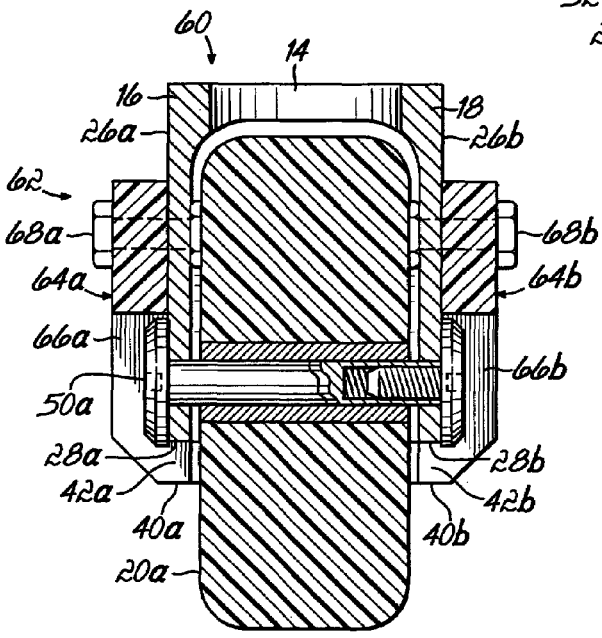
FIG. 8 is a cross-sectional view taken along line 8-8 of FIG. 7.

With reference to FIGS. 7 and 8, an in-line skate frame 60 and frame protector 62 are illustrated as part of a sub-assembly. This particular sub-assembly includes a series of four wheels 20*a,b,c,d* (one of which is shown in phantom), the skate frame 60, and the frame protector 62—all of which have been releasably assembled together. In this particular embodiment, the first and fourth wheels 20*a,d* are held in place via axle bolts 50*a,d* that extend through the frame 60 but not through the frame protector 62, given that the frame protector sidewalls 64*a,b* have notches 66*a,b* in these areas. The frame protector 62 is bolted to the underlying frame 60, as at 68*a,b*. And the second and third wheels 20*b,c* are held in place via axles 52 that extend through the frame 60 but not the frame protector 62. (See FIGS. 3 and 5 for an illustration of this feature.) In further detail, each of the frame protector sidewalls 64*a,b* includes an interior surface that is solid at the locations where the ends of the axles for the second and third wheels 20*b,c* are positioned. Accordingly, the sidewalls of the frame protector 64*a,b* serve to "capture" these axles in the transverse or lateral direction, thereby eliminating the need for conventional axle bolts at these positions.

Figure 9:
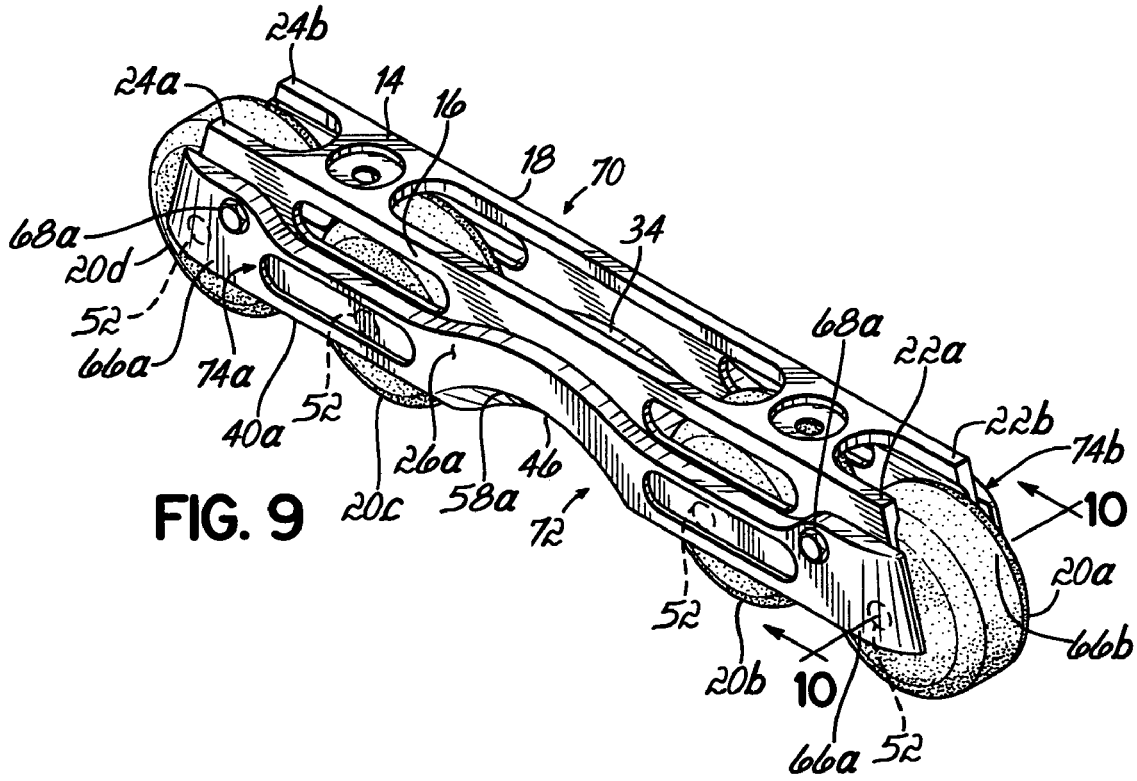
FIG. 9 is a perspective view of yet another in-line skate sub-assembly in which a further embodiment of the frame protector, in accordance with the principles of the invention, is releasably fastened to an in-line skate frame.
Figure 10:
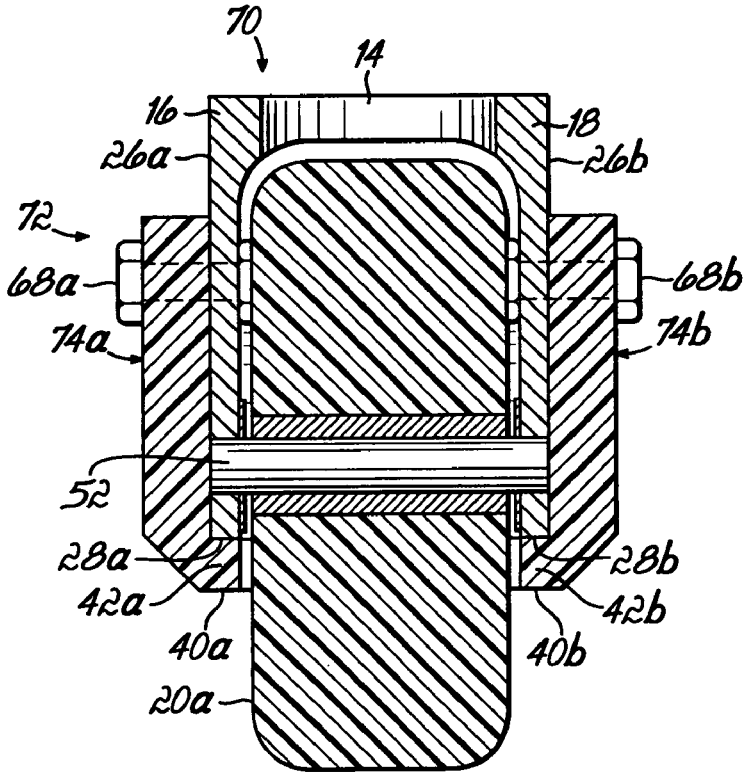
FIG. 10 is a cross-sectional view, taken along line 10-10 of FIG. 9.

With reference to FIGS. 9 and 10, an in-line skate frame 70 and frame protector 72 are illustrated as part of a sub-assembly. This particular sub-assembly includes a series of four wheels 20*a,b,c,d*, the skate frame 70, and the frame protector 72—all of which have been releasably assembled together. In this particular embodiment, the frame protector 72 is bolted to the underlying frame, as at 68*a,b*. In addition, all four wheels 20*a,b,c,d* are held in place via axles 52 that extend through the frame 70 but not the frame protector 72. (See, e.g., FIG. 10.) In further detail, each of the frame protector sidewalls 74*a,b* includes an interior surface that is solid at the locations where the ends of the axles 52 for each of the four wheels 20*a,b,c,d* are positioned. Accordingly, the sidewalls 74*a,b* of the frame protector 72 serve to "capture" these axles 52 in the transverse or lateral direction, thereby eliminating the need for conventional axle bolts at these positions.

The frame protector and in-line skate frame may be made using any suitable material(s) and manufacturing technique (s). For example, if desired, the frame protector may be made of any suitable plastic, metal, or composite material. If desired, the composite material may be a blend of a plastic (e.g., a nylon) and fiberglass. One such blend may be 80% nylon (e.g., an ultra high molecular weight nylon) and 20% fiberglass. Examples of manufacturing techniques for the frame protector include machining and thermoplastic injection molding. With regard to the in-line skate frame, examples of suitable materials include aluminum (e.g., 7071 aluminum), metallic alloys, plastics, and carbon-fiber materials. Examples of manufacturing techniques for the frame include cast molding, stamping, and machining.

While the present invention has been illustrated by a description of various embodiments, and while the illustrative embodiments have been described in considerable detail, it is not the intention of the inventor to restrict or in any way limit the scope of the appended claims to such detail. For example, although the frame protectors have been shown and described in connection with non-suspension frames, frame protectors in accordance with the present invention may be used with suspension frames. In addition, the frame protectors of the invention may be used with frames that simultaneously hold multiple sizes of wheels (e.g., "anti rocker" set-ups), with frames that use fewer than four wheels, and with frames in which the wheels are spaces along the frame in any desired spacing. Also, the invention includes frame protectors in which one or more wheels may be supported by the frame protector, as opposed to by the underlying frame. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of the inventor's general inventive concept.

What is claimed is:

1. A skate frame protector for use with an in-line skate frame, the in-line skate frame including a frame first sidewall and a frame second sidewall constructed and arranged to receive a plurality of in-line skate wheels therebetween, each of the frame first and second sidewalls including a first end, a second end, an exterior surface, and a lower edge, the skate frame protector comprising:

a first protective sidewall including a first end, a second end, and a bottom edge, the first protective sidewall constructed and arranged to be positioned at the exterior surface of the frame first sidewall, with the first end being proximate the frame first sidewall first end, the second end being proximate the frame first sidewall second end, and at least a portion of the bottom edge being proximate the frame first sidewall lower edge;

a second sidewall constructed and arranged to be positioned at the frame second sidewall, the second sidewall including a bottom edge; and the skate frame protector constructed and arranged so that a portion of each of the plurality of wheels extends below the first protective sidewall bottom edge and the second sidewall bottom edge, whereby a user may skate when the skate frame protector is positioned on the in-line skate frame.

2. The skate frame protector of claim 1 wherein the skate frame protector second sidewall is a second protective sidewall that includes a first end, a second end, and a bottom edge, the second protective sidewall constructed and arranged to be positioned at the exterior surface of the frame second sidewall, with the first end being proximate the frame second sidewall first end, the second end being proximate the frame second sidewall second end, and at least a portion of the bottom edge being proximate the frame second sidewall lower edge.

3. The skate frame protector of claim 1 wherein the first protective sidewall is integrally connected to the skate frame protector second sidewall.

4. The skate frame protector of claim 1 further including a bottom wall extending between the first protective sidewall and the skate frame protector second sidewall.

5. The skate frame protector of claim 1 wherein the first protective sidewall bottom edge is further constructed and arranged to extend downward beyond the frame first sidewall lower edge, from proximate the frame first sidewall first end to proximate the frame first sidewall second end.

6. The skate frame protector of claim 1 wherein each of the in-line skate frame first and second sidewalls includes an opening constructed and arranged to receive a portion of an axle, and wherein each of the skate frame protector first protective sidewall and skate frame protector second sidewall includes an interior surface constructed and arranged to overlap with the openings when the skate frame protector is positioned on the in-line skate frame, whereby each of the interior surfaces may retain an axle positioned in the openings.

7. The skate frame protector of claim 1 wherein the skate frame protector is formed of plastic.

8. The skate frame protector of claim 1 wherein the first protective sidewall first end extends to the frame first sidewall first end.

9. The skate frame protector of claim 1 wherein the first protective sidewall first end extends beyond the frame first sidewall first end.

10. The skate frame protector of claim 1 wherein the first protective sidewall first end includes a flange that covers at least a portion of a peripheral edge of the frame first sidewall first end when the skate frame protector is positioned on the in-line skate frame.

11. The skate frame protector of claim 3 further including a bottom wall extending between the first protective sidewall and the skate frame protector second sidewall, the first protective sidewall and the skate frame protector second sidewall being integrally connected via the bottom wall.

12. The skate frame protector of claim 11 wherein a portion of the bottom wall includes a downwardly-facing arcuate surface.

13. The skate frame protector of claim 4 wherein a portion of the bottom wall includes a downwardly-facing arcuate surface.

14. The skate frame protector of claim 13 wherein a portion of the first protective sidewall bottom edge is a downwardly-facing arcuate edge, the downwardly-facing arcuate edge being aligned with the downwardly-facing arcuate surface.

15. The skate frame protector of claim 5 wherein the first protective sidewall bottom edge is further constructed and arranged to extend underneath the frame first sidewall lower edge, from proximate the frame first sidewall first end to proximate the frame first sidewall second end.

16. The skate frame protector of claim 8 wherein the skate frame protector second sidewall is a second protective sidewall that includes a first end, with the second protective sidewall constructed and arranged to be positioned at the exterior surface of the frame second sidewall, wherein the second protective sidewall first end extends to the frame second sidewall first end.

17. The skate frame protector of claim 9 wherein the skate frame protector second sidewall is a second protective sidewall that includes a first end, with the second protective sidewall constructed and arranged to be positioned at the exterior surface of the frame second sidewall, wherein the second protective sidewall first end extends beyond the frame second sidewall first end.

18. The skate frame protector of claim 10 wherein the skate frame protector second sidewall is a second protective sidewall that includes a first end, with the second protective sidewall first end including a flange that covers at least a portion of a peripheral edge of the frame second sidewall first end when the skate frame protector is positioned on the in-line skate frame.

19. A skate frame protector for use with an in-line skate frame, the in-line skate frame including a frame first sidewall and a frame second sidewall constructed and arranged to receive a plurality of in-line skate wheels therebetween, each of the frame first and second sidewalls including a first end, a second end, an exterior surface, and a lower edge, the skate frame protector comprising:

a first protective sidewall including a first end, a second end, and a bottom edge, the first protective sidewall constructed and arranged to be positioned at the exterior surface of the frame first sidewall, with the first end being proximate the frame first sidewall first end, the second end being proximate the frame first sidewall second end, and at least a portion of the bottom edge being proximate the frame first sidewall lower edge; and a second sidewall constructed and arranged to be positioned at the frame second sidewall, wherein one of the in-line skate frame first and second sidewalls includes an opening constructed and arranged to receive a fastener, and wherein one of the first protective sidewall and skate frame protector second sidewall includes an aperture constructed and arranged to receive a fastener and to overlap with the opening when the skate frame protector is positioned on the in-line skate frame, whereby a fastener may be inserted through the opening and the aperture in order to attach the skate frame protector to the in-line skate frame.

20. The skate frame protector of claim 19 wherein each of the opening and the aperture is other than an opening or aperture for receiving an in-line skate wheel axle constructed and arranged to support an in-line skate wheel.

21. The skate frame protector of claim 19 wherein the fastener includes a bolt.

22. A skate frame protector for use with an in-line skate frame, the in-line skate frame including a frame first sidewall and a frame second sidewall constructed and arranged to receive a plurality of in-line skate wheels therebetween, each of the flame first and second sidewalls including a first end, a second end, an exterior surface, and a lower edge, the skate frame protector comprising:

a first protective sidewall including a first end, a second end, and a bottom edge, the first protective sidewall constructed and arranged to be positioned at the exterior surface of the frame first sidewall, with the first end being proximate the frame first sidewall first end, the second end being proximate the frame first sidewall second end, and at least a portion of the bottom edge being proximate the flame first sidewall lower edge; and a second sidewall constructed and arranged to be positioned at the frame second sidewall, wherein the skate frame protector second sidewall is a second protective sidewall that includes a first end, a second end, and a bottom edge, the second protective sidewall constructed and arranged to be positioned at the exterior surface of the frame second sidewall, with the first end being proximate the frame second sidewall first end, the second end being proximate the frame second sidewall second end, and at least a portion of the bottom edge being proximate the frame second sidewall lower edge, and wherein each of the in-line skate frame first and second sidewalls includes an opening constructed and arranged to receive a fastener, and wherein each of the skate frame protector first and second protective sidewalls includes an aperture constructed and arranged to receive a fastener and to overlap with the openings when the skate frame protector is positioned on the in-line skate frame, whereby a fastener may be inserted through the openings and the apertures in order to attach the skate frame protector to the in-line skate frame.

23. The skate frame protector of claim 22 wherein each of the openings and the apertures is constructed and arranged to receive an axle on which an in-line skate wheel is supported.

24. The skate frame protector of claim 22 wherein the fastener includes an axle bolt.

* * * * *